US011387088B2

(12) United States Patent
Li et al.

(10) Patent No.: US 11,387,088 B2
(45) Date of Patent: Jul. 12, 2022

(54) TARGET HOLDER ASSEMBLY OF ION PROBE AND METHOD FOR PREPARING SAMPLE TARGET THEREOF

(71) Applicant: INSTITUTE OF GEOLOGY AND GEOPHYSICS CHINESE ACADEMY OF SCIENCES (IGGCAS), Beijing (CN)

(72) Inventors: Jiao Li, Beijing (CN); Qiuli Li, Beijing (CN)

(73) Assignee: INSTITUTE OF GEOLOGY AND GEOPHYSICS CHINESE ACADEMY OF SCIENCES (IGGCAS), Beijing (CN)

( * ) Notice: Subject to any disclaimer, the term of this patent is extended or adjusted under 35 U.S.C. 154(b) by 0 days.

(21) Appl. No.: 17/327,377

(22) Filed: May 21, 2021

(65) Prior Publication Data

US 2021/0280405 A1 Sep. 9, 2021

Related U.S. Application Data

(63) Continuation of application No. PCT/CN2020/115585, filed on Sep. 16, 2020.

(30) Foreign Application Priority Data

Dec. 26, 2019 (CN) ..... 201911367225.X

(51) Int. Cl.
*H01J 49/00* (2006.01)
*H01J 49/04* (2006.01)

(52) U.S. Cl.
CPC ..... *H01J 49/0409* (2013.01); *H01J 49/0031* (2013.01)

(58) Field of Classification Search
CPC .. H01J 49/0409; H01J 49/0031; G01N 27/62; G01N 1/32; G01N 1/34; G01N 1/36; G01N 2001/364; G01N 2001/366
USPC ..... 250/281, 282, 288
See application file for complete search history.

(56) References Cited

U.S. PATENT DOCUMENTS 6,603,119 B1 * 8/2003 Giannuzzi ..... G01N 23/2255 250/252.1

* cited by examiner

*Primary Examiner* — Michael Maskell
(74) *Attorney, Agent, or Firm* — Westbridge IP LLC

(57) ABSTRACT

Disclosed are a target holder assembly of an ion probe and a method for preparing a sample target thereof. Specifically, the target holder assembly includes a body and sheets, a middle part of the body is provided with a sample target hole, and limiting portions are symmetrically arranged at an opening of the sample target hole away from a sample target entry side; and the sheets match the limiting portions in shape and dimension to form recesses on a sample target for receiving the limiting portions.

20 Claims, 4 Drawing Sheets

TARGET HOLDER ASSEMBLY OF ION PROBE AND METHOD FOR PREPARING SAMPLE TARGET THEREOF

CROSS-REFERENCE TO RELATED APPLICATIONS

The present application is a continuation of PCT application PCT/CN2020/115585 entitled "Target Holder Assembly of Ion Probe and Method for Preparing Sample Target Thereof" filed on Sep. 16, 2020, which claims priority of Chinese patent application 201911367225.X, filed on Dec. 26, 2019, the entire contents of which are incorporated herein by reference.

TECHNICAL FIELD

The present disclosure relates to the technical field of ion probes, in particular to a target holder assembly of an ion probe and a method for preparing a sample target thereof.

BACKGROUND

An ion probe, or also referred to as a Secondary Ion Mass Spectrometry (SIMS), refers to an instrument that bombards the surface of a sample by means of a high-energy ion beam and analyzes chemical elements and isotopic composition of the excited secondary ions. The ion probe has advantages of high mass resolution, high sensitivity and high analysis precision. The ion probe has small analysis beam spots (generally less than 20 microns), low sample consumption (10-9 grams), and irreplaceable technical advantages in the field of micro-area in situ analysis. Therefore, the ion probe has been widely applied in the fields of earth science, celestial geology and environmental geology.

SUMMARY

Examples of the present disclosure provide a target holder assembly of an ion probe and a method for preparing a sample target thereof, so as to reduce the influence of position changes on the reproducibility of analysis results.

The target holder assembly of an ion probe may include: a body and sheets, a middle part of the body is provided with a sample target hole, and limiting portions are symmetrically arranged at an opening of the sample target hole away from a sample target entry side; and the sheets match the limiting portions in shape and dimension to form recesses on a sample target for receiving the limiting portions.

The method for preparing a sample target according to any one of the above-mentioned target holder assemblies includes: pasting samples, standard materials and the sheets to a flat double-sided tape, wherein the sheets are symmetrically arranged; pouring and curing resin, and removing the sheets to obtain a sample target blank with recesses; and polishing the sample target blank, cleaning and then plating with gold to obtain the sample target.

It can be seen from the above target holder assembly of an ion probe and the method for preparing a sample target thereof that, the target holder assembly includes a body and sheets, a middle part of the body is provided with a sample target hole, and limiting portions are symmetrically arranged at an opening of the sample target hole away from a sample target entry side; and the sheets match the limiting portions in shape and dimension to form recesses on a sample target for receiving the limiting portions when the sample target is prepared. With this arrangement, the limiting portions are used to replace tungsten plates in the prior art to limit the sample target, and the surface of the sample target and the body are substantially in one plane, which eliminates electric field distortion of the sample target surface near an edge area due to the height difference, and reduces poor reproducibility caused by the fact that an analysis point is close to the boundary of the sample target.

BRIEF DESCRIPTION OF DRAWINGS

In order to explain one or more examples of the present disclosure more clearly, accompanying drawings illustrating examples of the present disclosure are briefly introduced. Obviously, the accompanying drawings are only one or more examples of the present disclosure. Those of ordinary skill in the art may further obtain other accompanying drawings based on these accompanying drawings without paying any creative work.

DETAILED DESCRIPTION OF THE EXAMPLES

In order to make objectives, technical solutions, and advantages of the present disclosure clearer, the present disclosure will be further described in detail with reference to specific examples described below together with the accompanying drawings.

It should be noted that, unless otherwise defined, the technical terms or scientific terms used in one or more examples of the present disclosure should have the ordinary meanings understood by persons with ordinary skills in the art. The terms "first", "second" and the like used in one or more examples of the present disclosure do not indicate any order, quantity or importance, but are only used for distinguishing different constituent components. The terms "comprising" or "containing" and the like mean that the element or object appearing in front of the term covers the elements or objects and their equivalents listed after the term, without excluding other elements or objects. The terms such as "connection" or "connected" and the like are not limited to physical or mechanical connections, but may comprise electrical connections, regardless of direct connection or indirect connection. The terms "up", "down", "left", "right" and the like are only used for indicating the relative position relationship. When the absolute position of the described object changes, the relative position relationship may also change accordingly.

It has been discovered that, in the process of SIMS sample testing, there is a position effect. That is, the change in the relative position of an analysis point directly affects the reproducibility of analysis results.

Figure 1A:
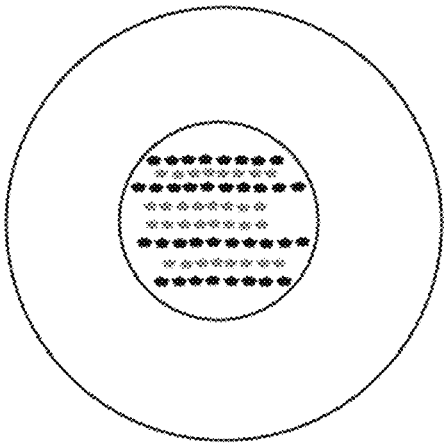
FIG. 1A is a schematic diagram illustrating the structure of a sample target according to an example of the present disclosure.
Figure 1B:
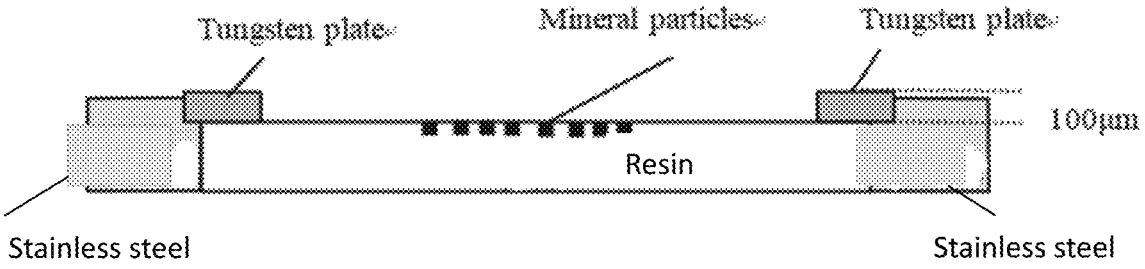
FIG. 1B is a schematic diagram illustrating the surface flatness of the sample target in FIG. 1A mounted in a sample target holder according to an example of the present disclosure.

At present, when a sample is tested with an ion probe, a sample target with a flat surface (as shown in FIG. 1A) needs to be prepared first. During testing, the sample target needs to be plated with gold and then loaded into a sample holder (as shown in FIG. 1B). The sample target can be fixed and placed in a sample compartment of an instrument for testing with the help of the sample target holder. Generally, the sample target holder is made of non-magnetic stainless steel, with a top flatly welded with a tungsten plate having a width of 3 mm and a thickness of 100 microns. Metal tungsten is used because it has sufficient hardness and is not easy to deform when processed to a thin plate having a thickness of 100 microns. A 2.6 cm cylindrical through hole for placing the sample target therein is in the middle of the sample target holder. As shown in FIG. 1B, the thickness 100 microns of the tungsten plate causes a height difference of 100 microns between the surface of the sample target and the side of the tungsten plate away from the sample target. The height difference will cause electric field distortion in an area close to the tungsten plate. When an analysis point is relatively close to the tungsten plate, the electric field formed by the tungsten plate itself will affect the trajectory of secondary ions, thereby affecting the reproducibility of data in the analysis process.

Therefore, the first aspect of examples of the present disclosure is to provide a target holder assembly of an ion probe. The structure of the target holder assembly can be referenced to FIG. 2 and FIG. 3. Specifically, the target holder assembly may include a body 1 and sheets 2, a middle part of the body 1 can be provided with a sample target hole 11. Limiting portions 12 are symmetrically arranged at an opening of the sample target hole 11 away from a sample target entry side. The sheets 2 match the limiting portions 12 in shape and dimension to form recesses on a sample target for receiving the limiting portions 12.

It should be noted that the recesses match the sheets 2 in depth and dimension. In this way, when the sample target is loaded into the body, the limiting portions can be clamped into the recesses formed by the sample target through the sheets. It should be understood that the depth refers to the length of the recess in the height direction of the sample target. Optionally, the dimension includes the length and width of the recess, that is, both the length and width of the recess match those of the sheet 2.

It should be noted that the limiting portions 12 extend from side walls of the sample target hole 11 into the sample target hole 11 to ensure that the surface of the body 1 away from the sample target entry side is flat.

Optionally, the sample target hole 11 is a cylinder with a diameter of 2.6 cm for placing the sample target therein.

With this arrangement, the limiting portions 12 are used to replace tungsten plates in the prior art to limit the sample target, and the limiting portions 12 abut against the recesses of the sample target, so that the surface, for placing samples, of the sample target and the surface, provided with the limiting portions 12, of the body 1 are substantially in one plane, which eliminates electric field distortion near an edge area due to the height difference, and reduces the reproducibility problem caused by an analysis point close to the boundary of the sample target.

It should be understood that since the width of the tungsten plate is 3 millimeters, the exposed range of the sample target is only 2 centimeters from the center, and its edges are all blocked by the tungsten plate on the sample target holder. At present, in order to avoid the influence of electric field distortion caused by the tungsten plate on the test, the sample is usually prepared in the center of the surface of the sample target with a diameter of 1.5 centimeters as much as possible. Due to area limitation, the number of samples that can be prepared each time is limited. The technical solution of replacing the tungsten plate with limiting portions in the examples of the present disclosure eliminates the electric field distortion near the edge area, so the sample can be arranged in a larger area and more samples can be analyzed.

In addition, usually 4-5 samples (each<200 particles) are prepared on one SIMS sample target. Only one sample target can be put into the SIMS sample compartment at a time, so in order to avoid the influence of matrix effect, the sample target needs to be equipped with 2-3 kinds of standard materials. These standard material particles cannot be recycled, so the shortage of standard materials will inevitably become one of the most important problems for laboratories over time. The technical solution of replacing the tungsten plate with limiting portions in the examples of the present disclosure can prepare and analyze more samples at a time, that is, improve the utilization rate of standard materials and achieve the purpose of saving standard materials.

Figure 2:
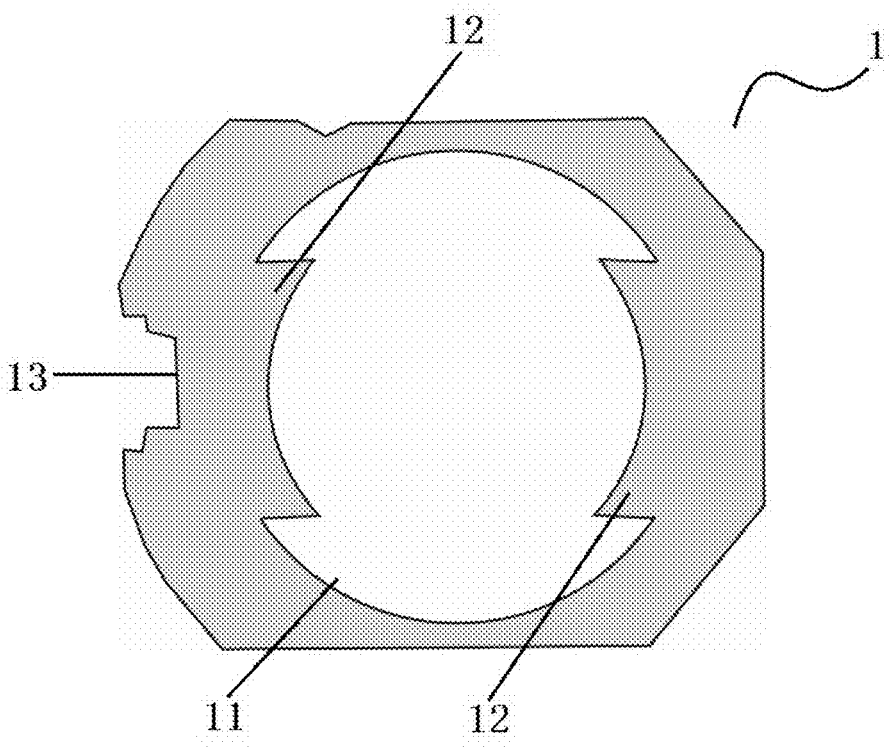
FIG. 2 is a schematic diagram illustrating the structure of a body in a sample target holder assembly according to an example of the present disclosure.
Figure 3:
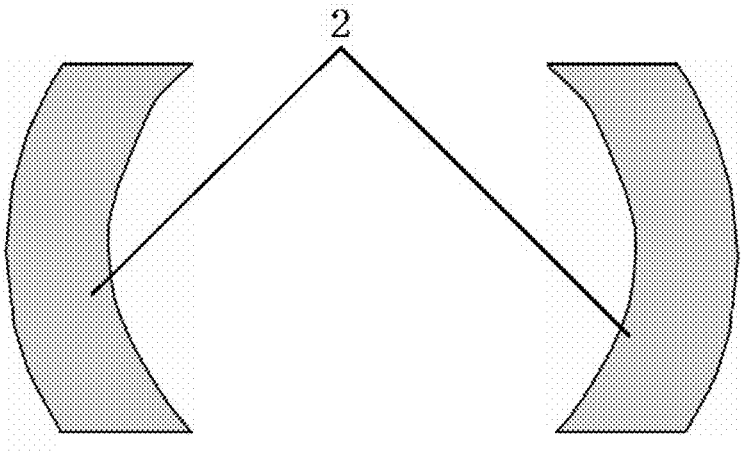
FIG. 3 is a schematic diagram illustrating the structure of corresponding sheets in the sample target holder assembly in FIG. 2 according to an example of the present disclosure.

In some examples of the present disclosure, the number of the limiting portions 12 is two (refer to FIG. 2). Compared with the technical solution of welding tungsten plates on four sides, two limiting portions can be sufficient to limit the sample target. In this case, by using two limiting portions, the exposed area of the sample target can be increased, the number of samples that a sample target can hold can be increased, and the utilization rate of standard materials can be improved.

It should be understood that the number of the limiting portions may also be three, four, and etc. A person skilled in the art can understand that any number of limiting portions can be available as long as they can form a symmetrical structure.

In some examples of the present disclosure, the length of the limiting portion 12 along the extending direction of the sample target hole 11 can be 0.9 mm to 1.1 mm, which can be considered as a thickness here. By setting the thickness of the limiting portion to be 0.9 mm to 1.1 mm, the strength of the limiting portion can be ensured, and the limiting portion can be reused without deformation. Correspondingly, the depth of the recess on the sample target is appropriate without affecting the structural stability of the entire sample target.

In some examples of the present disclosure, the length of the limiting portion 12 perpendicular to the extending direction of the sample target hole 11 can be 1.9 mm to 2.1 mm. With this arrangement, the position of the sample target can be set more stably, and the sample target can be finally fixed. Optionally, the direction perpendicular to the extending direction of the sample target hole 11 refers to a direction from the edge of the sample target hole 11 to the center of the sample target hole 11. Correspondingly, the length here refers the distance of the limiting portion 12 from the edge of the sample target hole 11 to the center of the sample target hole 11.

In some examples of the present disclosure, the limiting portions 12 are sector-shaped. With the sector-shaped limiting portions 12, the limiting portions 12 can be stably connected to the opening of the sample target hole, while providing a sufficient area to contact the sample target to limit the position of the sample target.

A person skilled in the art can understand that the shape of the limiting portions may also be trapezoidal, rectangular, zigzag, or the like. The shape here is only illustrative, and any suitable shape can also be used for the limiting portions 12.

It should be understood that since the sheets 2 match the limiting portions 12 in shape and dimension, any of the aforementioned limitations on the limiting portions 12 also affects the sheets 2, so details are not described herein again.

In some examples of the present disclosure, the body 1 is further provided with a groove 13, and the groove 13 is used to connect a sampling rod. It should be noted that the sampling rod is a component of the ion probe device, and the sampling rod can feed/remove the sample target into/from the sample compartment. Through the groove 13, the body 1 can be conveniently connected to the sampling rod.

In some examples of the present disclosure, the body 1 is further provided with a threaded hole (not shown), and the threaded hole cooperates with a screw to fix the sample target.

It should be noted that after the sample target is loaded, a spring needs to be placed in the center of the back of the sample target, then a bottom baffle is placed, and the screw is screwed into the threaded hole to fix the sample target.

Optionally, the threaded hole and the groove are arranged on two sides of the body 1.

Such arrangement can ensure that the structure of the body 1 is balanced and is more stable as a whole.

Optionally, the threaded hole is symmetrically arranged with respect to the symmetry axis of the groove. With such a structure, the force of the sample target is more balanced in the direction perpendicular to the symmetry axis, therefore, the sample target is prevented from tilting, the sample target is flatly loaded into the body 1, and the position effect is reduced.

In some examples of the present disclosure, the body 1 can be integrally formed. Through integrated processing, the body 1 cannot be easily deformed, and meets reuse requirements of laboratory tests.

Optionally, the material of the body 1 can be non-magnetic stainless steel, which can avoid the influence of the body 1 on an ion beam path during SIMS tests.

Optionally, the material of the body 1 is 316 stainless steel with a Vickers hardness of 89. The 316 stainless steel for preparing the body 1 can ensure that the body 1 has sufficient strength, is not easily deformed and can be reused.

It should be noted that in the process of preparing the body 1, the surface of the body 1 needs to be polished, especially the surface in contact with the sample target needs to be polished. A smooth surface can be formed by polishing to ensure a closer contact between the body 1 and the sample target.

In some examples of the present disclosure, the material of the sheets 2 is 316 stainless steel with a Vickers hardness of 89. It should be understood that the surfaces of the sheets 2 need to be polished to mirror surfaces, which can reduce surface friction of the sheets 2 as much as possible to ensure that the surfaces of recesses formed on the sample target are smooth, and is beneficial to form a close contact between the sample target 3 and the body 1.

Figure 6:
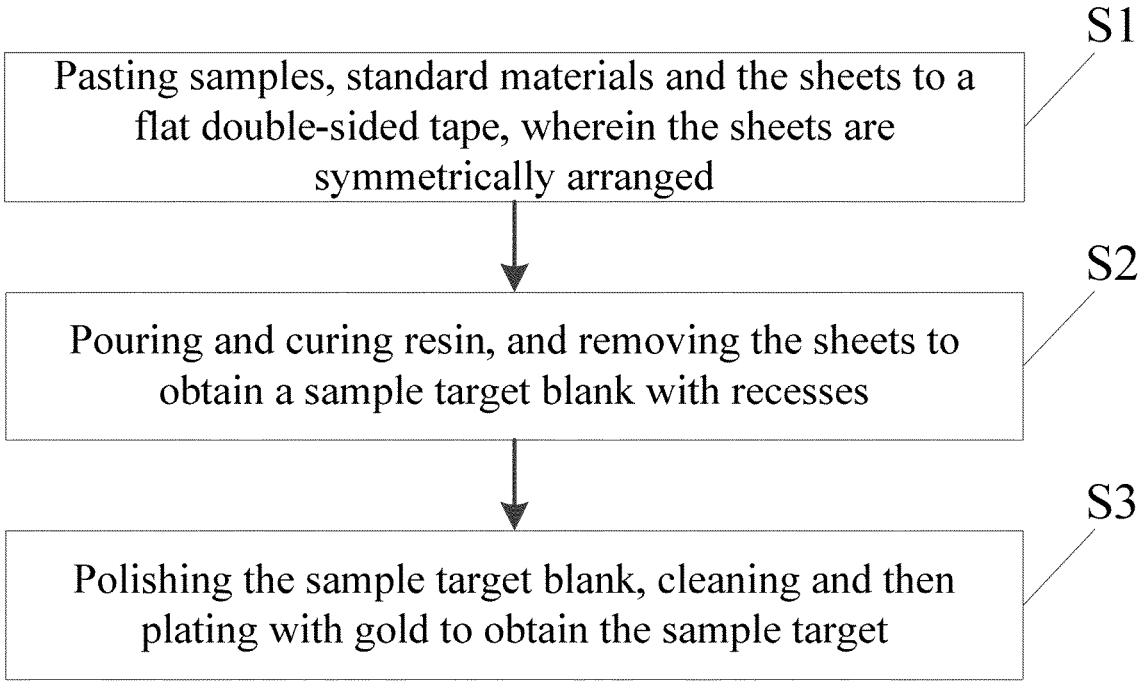
FIG. 6 is a schematic flowchart of a method for preparing a sample target according to an example of the present disclosure.

Referring to FIG. 6, the second aspect of examples of the present disclosure provides a method for preparing a sample target according to any one of the foregoing target holder assemblies, which includes the following steps.

Step S1: samples, standard materials and the sheets 2 are pasted to a flat double-sided tape, wherein the sheets 2 are symmetrically arranged.

The standard materials are used to correct data after subsequent instrument test.

It should be noted that the flat double-sided tape can be conveniently obtained by flatly pasting a double-sided tape to a glass.

Optionally, during pasting, a sampling needle or tweezers can be used to pick and place the samples, standard materials, and sheets 2 to avoid contamination of the effective samples, standard materials, and sheets.

Optionally, the sheets 2 can be wiped with dust-free paper dipped in high-purity alcohol, dried and then pasted, so as to avoid contamination to resin poured in the later stage.

Figure 4:
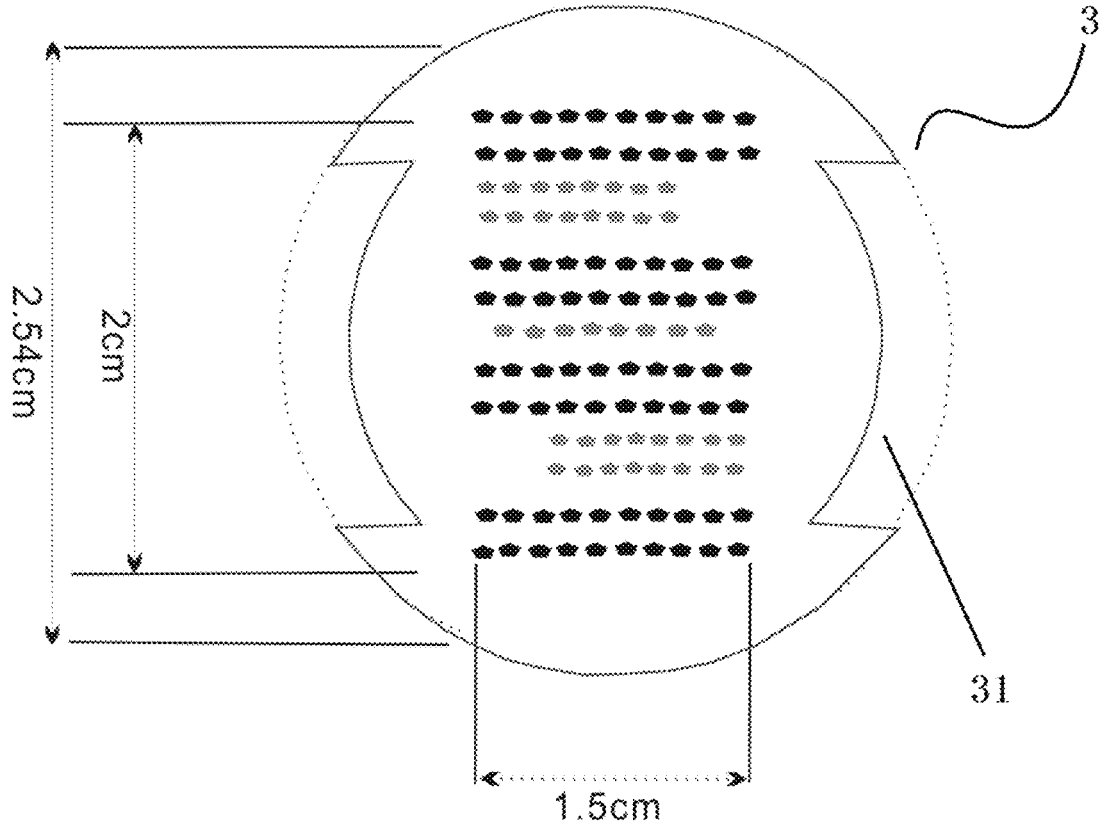
FIG. 4 is a schematic diagram illustrating the structure of a sample target according to another example of the present disclosure.

Referring to FIG. 4, a cylindrical sample target having a diameter of 2.54 centimeters (cm) and a thickness of about 5 millimeters (mm) is prepared as an example to illustrate the pasting means of the samples, standard materials, and sheets.

Here, in the diameter range of 2.54 cm, two sheets 2 can be symmetrically pasted, and two recesses 31 can be correspondingly formed. For ease of description, it is assumed that the direction of the symmetry axis of the sheets 2 is a first direction, and the direction perpendicular to the symmetry axis is a second direction. Because the sheets 2 need to be arranged in the first direction (corresponding to the limiting portions 12 of the body 1), the length of each row of sample particles in the first direction can be up to 1.8 cm (1.5 cm as example in FIG. 4). Because the sheets 2 are not arranged in the second direction, the sample can be pasted within a range of 2.2 cm (2 cm as an example in FIG. 4). There is a distance of about 1 mm between the samples to avoid mixing. A total of 7-9 samples can be pasted. Compared with a target holder with a tungsten plate, the electric field distortion caused by the height difference can be eliminated, the test accuracy of the edge of the sample target can be improved, samples can be arranged close to the edge of the sample target, and the number of samples tested at one time can be significantly increased.

Step S2: resin is poured and cured, and the sheets 2 are removed to obtain a sample target blank with recesses 31.

The recesses 31 match the sheets 2 in depth and width. Illustratively, when the sheets 2 are of sectors having a thickness of 1 mm and a width of 2 mm, the recesses 31 have a depth of 1 mm and a width of 2 mm.

It can be understood by a person skilled in the art that before the resin is poured, a peripheral mold for the sample target needs to be placed in an appropriate position, and the samples, the standard materials and the sheets are all located inside the peripheral mold. The peripheral mold is used to form a side profile of the sample target. Further, the sheets are tightly attached to the inner side of the peripheral mold to form recesses extending from the periphery to the inner side.

It should be noted that the technical solution of the present application does not involve an improvement on the peripheral mold, so details are not described herein. Exemplarily, when the aforementioned 2.54 cm cylindrical sample target is formed, the peripheral mold is a circular tube with an inner diameter of 2.54 cm.

Step S3: the sample target blank is polished, cleaned and then plated with gold to obtain the sample target. Here, the gold plating is used to ensure electrical conductivity of the sample target during testing.

Optionally, the target surface of the sample target blank is polished with sandpaper, diamond, and polishing paste until most of the sample particles are exposed to half of the surface.

Optionally, high-purity alcohol and deionized water are used for cleaning.

In some examples of the present disclosure, before the sheets 2 are pasted, a release agent is applied to the sheets 2. The release agent ensures that the sheets 2 can be smoothly and conveniently removed after the resin is cured.

When the sample target is a cylinder with a diameter of 2.54 cm, the back of the sample target prepared by the method of the examples of the present disclosure is a circle with a diameter of 2.54 cm, and there are 1 mm deep sector-shaped recesses on two sides of the sample surface in the first direction.

Figure 5:
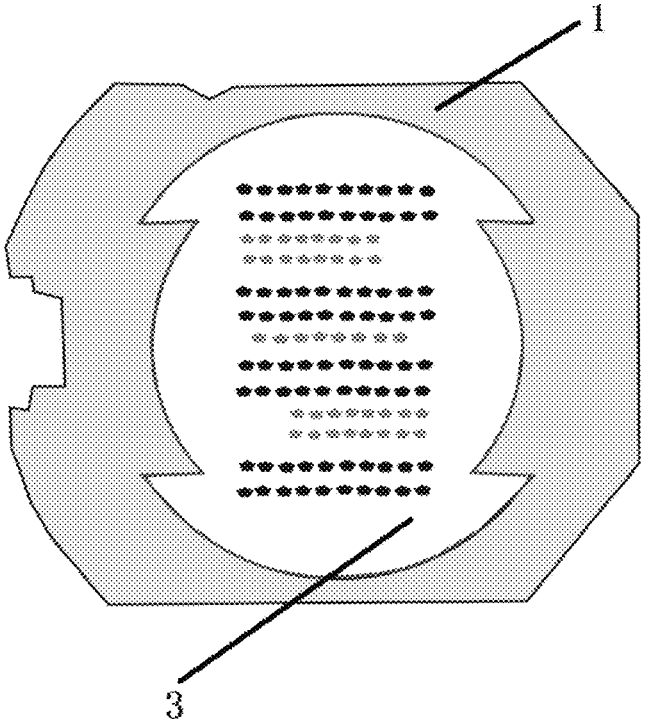
FIG. 5 is a schematic diagram illustrating the structure of the sample target mounted in the body according to an example of the present disclosure.

As shown in FIG. 5, during testing on a SIMS instrument, the prepared sample target (having a diameter of 2.54 cm and a thickness of 5 mm) needs to be flatly loaded into the matching body 1, and then fed into the instrument for testing. Specifically, the prepared sample target is loaded into the body 1, and the limiting portions 12 of the body 1 are clamped into the recesses 31 formed by the sheets 2 of the sample target. Therefore, the sample surface of the sample target 3 and the surfaces of the limiting portions 12 are almost coplanar, and the contact positions between the sample target 3 and the body 1 are all slits.

It can be seen that the target holder assembly and the preparation method of the sample target provided by the examples of the present disclosure can reduce the height difference of 100 micrometers in the contact part between the ion probe target holder and the sample target surface to less than 10 micrometers, which effectively improves the overall flatness (<10 microns) after the sample target is loaded into the body 1. Moreover, the contact parts between the sample target and the body 1 are all slits (width <0.5 mm), which improves the precision of ion probe test data, significantly reduces the "position effect" caused by a tungsten plate of a target holder, and improves the reproducibility of the sample ion probe test data.

In addition, more samples can be pasted to the sample target, the space utilization of the sample target surface is improved, more samples can be prepared on the same sample target, and the use efficiency of standard materials is improved.

Finally, the method for preparing the sample target according to the examples of the present disclosure is simple and easy to operate.

The foregoing describes specific examples of this Description. Other examples fall into the scope of the appended claims. In some cases, the operations or steps described in the claims may be performed in an order different from that in the examples and still achieve the desired results. In addition, the processes described in the drawings do not necessarily require a particular order shown or a sequential order to achieve the desired results. In some examples, multitasking and parallel processing may be permissible or advantageous.

A person of ordinary skill in the art should understand that: the discussion of any of the above examples is only exemplary, and is not intended to imply that the scope of the present disclosure (including the claims) is limited to these examples; under the idea of the present disclosure, the above examples or the technical features in the different examples can also be combined, the steps can be implemented in any order, and there are many other changes in the different aspects of the present disclosure as described above, which are not provided in the details for the sake of brevity.

Although the present disclosure is described in conjunction with specific examples of the present disclosure, many substitutions, modifications and variations of these examples will be apparent to those of ordinary skill in the art based on the foregoing description. For example, other memory architectures (such as dynamic RAM (DRAM)) can use the discussed examples.

The examples of the present disclosure are intended to cover all such substitutions, modifications and variations that fall within the broad scope of the appended claims. Therefore, any omissions, modifications, equivalent substitutions, improvements, and the like made within the spirit and principle of the present disclosure should be included in the protection scope of the present disclosure.

What is claimed is:

1. A target holder assembly of an ion probe, comprising:
a body and sheets, wherein
a middle part of the body is provided with a sample target hole;
limiting portions are symmetrically arranged at an opening of the sample target hole away from a sample target entry side; and
the sheets match the limiting portions in shape and dimension to form recesses on a sample target for receiving the limiting portions; wherein the recesses match the sheets in depth and dimension, so that when the sample target is loaded into the body, the limiting portions can be clamped into the recesses formed by the sample target through the sheets.

2. The target holder assembly according to claim 1, wherein a number of the limiting portions is two.

3. The target holder assembly according to claim 1, wherein a number of the limiting portions is three or four.

4. The target holder assembly according to claim 1, wherein a length of the limiting portion along an extending direction of the sample target hole is 0.9 mm to 1.1 mm.

5. The target holder assembly according to claim 1, wherein a length of the limiting portion perpendicular to the extending direction of the sample target hole is 1.9 mm to 2.1 mm.

6. The target holder assembly according to claim 1, wherein the limiting portions are sector-shaped.

7. The target holder assembly according to claim 1, wherein the limiting portions are in shape of a trapezoid, a rectangle, or a zigzag shape.

8. The target holder assembly according to claim 1, wherein the body is further provided with a groove; the groove connects to a sampling rod.

9. The target holder assembly according to claim 1, wherein the body is further provided with a threaded hole; the threaded hole cooperates with a screw to fix the sample target.

10. The target holder assembly according to claim 1, wherein the body is integrally formed.

11. The target holder assembly according to claim 1, wherein the body is made of non-magnetic stainless steel.

12. The target holder assembly according to claim 11, wherein the body is made of 316 stainless steel with a Vickers hardness of 89.

13. The target holder assembly according to claim 1, wherein the sheets are made of 316 stainless steel with a Vickers hardness of 89.

14. The target holder assembly according to claim 1, wherein the surface of the body and the sheets are polished.

15. The target holder assembly according to claim 1, wherein the sample target hole is a cylinder with a diameter of 2.6 cm for placing the sample target therein.

16. A method for preparing a sample target applied to the target holder assembly according to claim 1, comprising:

pasting samples, standard materials and the sheets to a flat double-sided tape, wherein the sheets are symmetrically arranged;

pouring and curing resin, and removing the sheets to obtain a sample target blank with recesses; and polishing the sample target blank, cleaning the sample target blank and then plating the sample target blank with gold to obtain the sample target.

17. The method according to claim 16, wherein before the sheets are pasted, a release agent is applied to the sheets.

18. The method according to claim 16, wherein, polishing the sample target blank comprises: polishing the sample target blank with sandpaper, a diamond, and polishing paste until a half of sample particles are exposed.

19. The method according to claim 16, wherein, cleaning the sample target blank comprises: cleaning the sample target blank with high-purity alcohol and deionized water.

20. The method according to claim 16, further comprising: wiping the sheets with dust-free paper dipped in high-purity alcohol and drying the sheets before pasting the samples, the standard materials and the sheets to the flat double-sided tap.

* * * * *